US007611024B2

(12) United States Patent
Yamanaka et al.

(10) Patent No.: US 7,611,024 B2
(45) Date of Patent: Nov. 3, 2009

(54) CAP

(75) Inventors: Yasuhiro Yamanaka, Higashi-Osaka (JP); Takahiro Fujita, Higashi-Osaka (JP)

(73) Assignee: M.F.V. Co., Ltd., Osaka (JP)

( * ) Notice: Subject to any disclaimer, the term of this patent is extended or adjusted under 35 U.S.C. 154(b) by 0 days.

(21) Appl. No.: 12/364,818

(22) Filed: Feb. 3, 2009

(65) Prior Publication Data

US 2009/0194501 A1 Aug. 6, 2009

(30) Foreign Application Priority Data

Feb. 4, 2008 (JP) ..... P2008-024030

(51) Int. Cl.

*B65D 43/26* (2006.01)
*B65D 43/16* (2006.01)
*B65D 51/18* (2006.01)
*B65D 41/02* (2006.01)

(52) U.S. Cl. ..... 215/237; 220/254.3; 220/259.1; 220/263; 220/281; 220/835

(58) Field of Classification Search ..... 215/237, 215/244, 245; 220/254.3, 254.4, 281, 282, 220/283, 259.1, 263, 835

See application file for complete search history.

(56) References Cited

U.S. PATENT DOCUMENTS 5,573,127 A * 11/1996 Takahashi et al. ..... 215/237
5,582,316 A * 12/1996 Masayoshi et al. ..... 220/264
5,873,476 A * 2/1999 Takahashi et al. ..... 215/237
6,834,769 B2 * 12/2004 Takahashi et al. ..... 215/235
2002/0148802 A1 * 10/2002 Takahashi et al. ..... 215/237
2006/0151416 A1 * 7/2006 Hennemann et al. ..... 215/235
2006/0273062 A1 * 12/2006 Delage ..... 215/237
2008/0023477 A1 * 1/2008 Markert ..... 220/259.1

FOREIGN PATENT DOCUMENTS

JP 6-76094 U 10/1994
JP 7-9747 U 2/1995
JP 2002-37294 A 2/2002

* cited by examiner

*Primary Examiner*—Anthony D Stashick
*Assistant Examiner*—Niki M Eloshway
(74) *Attorney, Agent, or Firm*—Birch, Stewart, Kolasch & Birch, LLP

(57) ABSTRACT

A cap is provided which can be smaller in number of constituent elements, easy to manufacture with simple assembly operation, and of which cap cover can be smoothly opened with one hand for a long period of time. In the cap configured so that a pressing portion presses an opening/closing hinge of the cap cover backward to swing the cap cover in an open direction when a manipulation portion is pressed, a manipulation body includes an elastic connection rod arranged on a side of an outlet below a support, the manipulation portion is provided on a front end of the elastic connection rod, the pressing portion is provided on a rear end of the elastic connection rod, and the manipulation body is connected to the support via a deformable connection piece so as to allow a longitudinal movement of the manipulation body relative to the support.

16 Claims, 13 Drawing Sheets

CAP

BACKGROUND OF THE INVENTION

1. Field of the Invention

The present invention relates to a cap used in a container such as a bottle for cosmetics.

2. Description of the Related Art

As a cap used in a container such as a bottle for cosmetics, there is known a cap having a cap main body that is attached to a mouth of a container main body and that includes an outlet projecting upward and a cap cover connected to a rear end of the cap main body via an opening/closing hinge so as to be able to cover a top portion of the cap main body with the cap cover and to freely open or close the top portion of the cap main body.

One conventional cap of this type is configured so that a manipulation body is provided on a top surface of the cap main body so as to be slidable longitudinally, a manipulation portion is provided on a front end of the manipulation body, and so that a pressing portion is provided on a rear end of the manipulation body. When a user presses the manipulation portion backward, then a front portion of the cap cover is pressed upward in a front portion of the manipulation body so as to swing the cap cover in an open direction, and the pressing portion of the manipulation body presses an opening/closing hinge of the cap cover so as to further swing the cap cover in the open direction. The user can thereby easily open the cap cover even with one hand. This conventional cap is disclosed in, for example, Japanese Unexamined Patent Application Publication No. 2002-37294.

Another conventional cap of this type is configured so that a support fixed to the cap main body and a manipulation body supported by the support are provided, the support is externally fitted into an outlet to cover up downward of an outer circumference of the outlet, the manipulation body is arranged below the support, a manipulation portion is provided on a front end of the manipulation body, and so that a pressing portion is provided on a rear end of the manipulation body. When a user presses backward the manipulation portion, a front portion of the cap cover is pressed upward in a front portion of the manipulation body so as to swing the cap cover in an open direction. The pressing portion of the manipulation body presses an opening/closing hinge of the cap cover so as to further swing the cover cap in the open direction. The user can thereby open the cap cover more easily even with one hand. This cap is disclosed in, for example, Japanese Unexamined Utility Model Application Publication Nos. Hei 7-9747 and Hei 6-76094.

The former conventional cap has the following problems. The manipulation body is plate-like and the plate-like manipulation body is provided on the top surface of the cap main body so as to be slidable longitudinally. Due to this, a resistance between the manipulation body and the cap main body increases, which often makes it impossible for the manipulation body to smoothly slide. In particular, a content of the container flowing out from the outlet is soaked, deposited and grown in a sliding portion (movable portion) of the manipulation body in which the manipulation body slides relatively to the cap main body. This gradually deteriorates a movement of the manipulation body, with the result that the user is often incapable of easily opening the cap cover with one hand.

The latter conventional cap has the following problem. Since the support and the manipulation body are formed separately, the number of constituent elements of the cap increases accordingly. This makes manufacturing of the cap complicated and cumbersome. Furthermore, it is necessary to separately assemble the support and the manipulation body with the cap main body, resulting in a complicated cap assembly operation.

Moreover, both the former and latter conventional caps have the following common problems. Since the manipulation body is formed into a plate shape, a force of pressing the manipulation portion of the manipulation body backward is transmitted directly to the pressing portion and the pressing portion strongly presses the opening/closing hinge of the cap main body right before start of opening of the cap cover. Due to this, in the case where an opening/closing operation for opening/closing the cap cover is repeated, then the opening/closing hinge is broken or damaged, with the result that the cap cover cannot be smoothly opened or closed after use of a short period of time. Besides, in each of the former and latter conventional caps, the manipulation body has a large sliding surface and a high sliding resistance. Due to this, in the case where the content adheres to the manipulation body, the sliding operation of the manipulation body is adversely influenced.

SUMMARY OF THE INVENTION

The present invention has been made in view of the conventional problems. It is an object of the present invention to provide a cap which can be smaller in number of constituent elements, easy to manufacture with simple assembly operation, and of which cap cover can be smoothly opened with one hand for a long period of time.

According to one aspect of the present invention, there is provided a cap including: a cap main body attached to a mouth of a container main body and including an outlet; a cap cover connected to a rear end of the cap main body via an opening/closing hinge so as to be able to cover a top portion of the cap main body with the cap cover and to freely open or close the top portion of the cap main body; and a support fixed to the cap main body and a manipulation body supported by the support, the manipulation body being arranged on a top portion of the cap main body to be longitudinally movable, the support being fixedly attached to the cap main body so as to close an area between the outlet and the manipulation body above the manipulation body, the manipulation body being provided with a manipulation portion and with a pressing portion on a rear end of the manipulation body, the pressing portion pressing the opening/closing hinge of the cap cover backward to swing the cap cover in an open direction when the manipulation portion is pressed, wherein the manipulation body includes an elastic connection rod arranged on a side of the outlet below the support, the manipulation portion is provided on one end of the elastic connection rod, the pressing portion is provided on other end of the elastic connection rod, and the manipulation body is connected to the support via a deformable connection piece so as to allow a movement of the manipulation body relative to the support.

According to another aspect of the present invention, when the manipulation portion is pressed with the cap cover in a closed state, a front portion of the cap cover is pressed upward in a manipulation portion of the manipulation body so as to swing the cap cover in the open direction, and the pressing portion presses the opening/closing hinge of the cap cover backward to further swing the cap cover in the open direction.

According to still another aspect of the present invention, when the manipulation portion is pressed with the cap cover in a closed state, then engagement for keeping the cap cover at a closed position is released, and the pressing portion presses the opening/closing hinge of the cap cover backward to swing the cap cover in an open direction.

According to yet another aspect of the present invention, the manipulation body is formed into a shape of a ring having a pair of elastic connection rods arranged on both sides of the outlet, respectively below the support, the manipulation portion is provided between front ends of the pair of elastic connection rods, the pressing portion is provided between rear ends of the pair of elastic connection rods, and the manipulation body is connected to the support via the deformable connection piece so as to allow a longitudinal movement of the manipulation body relative to the support.

According to yet another aspect of the present invention, an accommodation concave portion having an opening on an upper end is provided in the cap main body so as to surround downward of the outlet, the manipulation body is accommodated in the accommodation concave portion to be movable longitudinally, and the support is fixedly attached to the cap main body so as to close the opening of the upper end of the accommodation concave portion.

According to yet another aspect of the present invention, a fitting hole is provided in the support, and the support is externally fitted into and fixed to the outlet via the fitting hole and fitted into and fixedly attached to the cap main body so as to close the opening of the upper end of the accommodation concave portion.

According to yet another aspect of the present invention, one end of the connection piece is bendably connected to the manipulation body and other end of the connection piece is bendably connected to the support.

According to yet another aspect of the present invention, the connection piece is formed into a belt shape so as to be flexibly bendable over an entire length.

According to yet another aspect of the present invention, the cap main body includes an outer circumferential wall, an inner circumferential wall and a top wall, the inner circumferential wall is externally fitted into the mouth of the container main body, a convex portion projecting upward is provided on the top wall, the outlet is provided to project upward of a top wall of the concave portion, and the accommodation concave portion is formed between a top portion of the outer circumferential wall and a circumferential wall of the convex portion.

According to the present invention, the manipulation body includes the elastic connection rod arranged on the side of the outlet below the support, the manipulation portion is provided on one end of the elastic connection rod, the pressing portion is provided on the other end of the elastic connection rod, and the manipulation portion is connected to the support via the deformable connection piece so as to allow the movement of the manipulation body relative to the support. Due to this, the support and the manipulation body can be formed integrally with each other and the number of constituent elements of the cap can be reduced, thereby facilitating a cap assembly operation.

Moreover, when the manipulation portion is pressed, then the pressing portion of the manipulation body first abuts on the opening/closing hinge of the container main body and then the elastic connection rod elastically deforms to follow the movement of the manipulation portion of the manipulation body. Due to this, when the cap cover starts opening, it is possible to effectively relax and absorb a force with which the pressing portion presses the opening/closing hinge, prevent the pressing portion to strongly press the opening/closing hinge with an excessively strong force at one time, effectively prevent the opening/closing hinge from being broken or damaged and smoothly and surely open the cover cap for a long period of time. Moreover, the manipulation body is arranged in a top portion of the cap main body to be longitudinally movable and the support is fixedly attached to the cap main body so as to close an area between the outlet and the manipulation body above the manipulation body. Due to this, the support can protect the content ejected from the outlet from flowing out toward the manipulation body. It is thereby possible to prevent the content of the container from adhering to the manipulation body and open the cap cover smoothly for a long period of time.

Besides, the manipulation body is connected to the support only via the connection piece and the portions of the manipulation body other than portions connected to the support via the connection piece are free (unconnected). Even during ordinary use, the interfering portions are not present and a sliding resistance is low, accordingly. Due to this, even if the content of the container adheres to the manipulation body, the manipulation body is not so greatly adversely influenced by the adhesion of the content.

DETAILED DESCRIPTION

Figure 1:
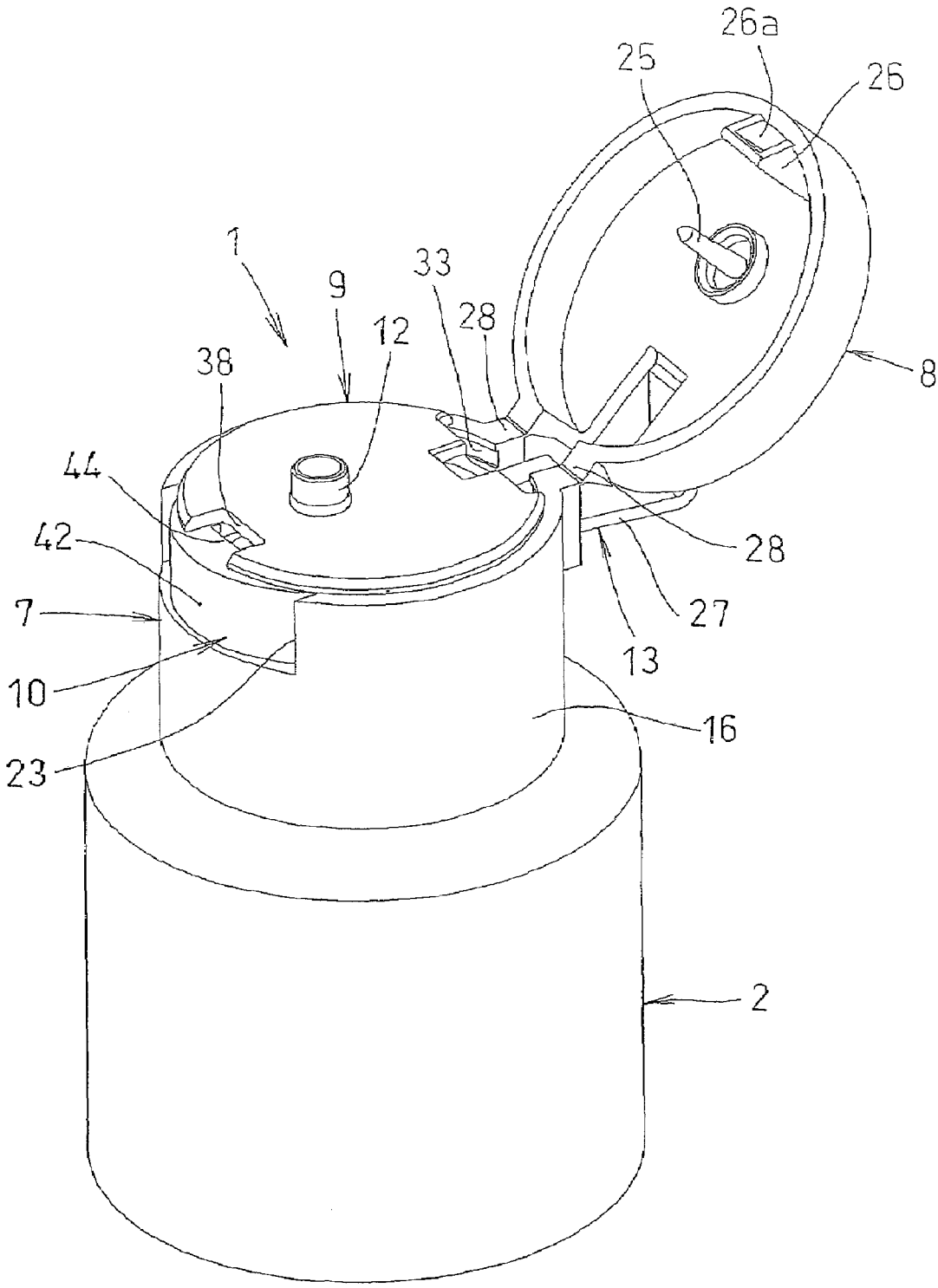
FIG. 1 is a perspective view of a container showing a cap cover in an opened state in accordance with an embodiment of the present invention.

Embodiments of the present invention will be described hereinafter based on the drawings.

FIGS. 1 to 8 show a cap 1 according to one embodiment of the present invention.

In FIGS. 1 to 8, the cap 1 is detachably attached to a mouth 3 of a container main body 2 and a container such as a bottle for cosmetics is constituted by the container main body 2 and the cap 1.

The cap 1 includes a cap main body 7 and a cap cover 8 that covers up a top portion of the cap main body 7. The cap 1 also includes a support 9 fixed to the cap main body 7 and a manipulation body 10 supported by the support 9. The cap main body 7 includes an outlet 12 attached to the mouth 3 of the container main body 2 and projecting upward. The cap cover 8 is connected to a rear end of the cap main body 7 via an opening/closing hinge 13 and configured to cover up the top portion of the cap main body 7 so as to be able to freely open or close the cap main body 7.

The cap main body 7, the cap cover 8 and the opening/closing hinge 13 are formed integrally out of synthetic resin. The manipulation body 10 is connected to the support 9 via connection pieces 46, to be described later, and the manipulation body 10, the support 9 and the connection pieces 46 are formed integrally out of synthetic resin. It is to be noted that the support 9 and the manipulation body 10 are formed separately from the cap main body 7 and the cap cover 8.

The cap main body 7 includes an outer circumferential wall 16, an inner circumferential wall 17 and a top wall 18, and a lower end of the inner circumferential wall 17 is connected to a lower end of the outer circumferential wall 16 by a connection wall 19. A convex portion 20 projecting upward is provided on the top wall 18. The convex portion 20 is formed into a bottomed cylinder including a top wall 21 and a circumferential wall 22. An outlet 12 is provided in the top wall 21 of the convex portion 20 to project upward and an accommodation concave portion 24 is formed between a top portion of the outer circumferential wall 16 and the circumferential wall 22 of the convex portion 20. The accommodation concave portion 24 having an opening on an upper end is provided in the cap main body 7 and configured to surround downward of the outlet 12 in a ring fashion.

A female screw is formed on an inner circumference of the inner circumferential wall 17 of the cap main body 7 and a male screw is formed on an outer circumference of the mouth 3 of the container main body 2. The inner circumferential wall 17 is detachably engaged with the mouth 3 of the container main body 2 via the male and female screws, whereby the cap main body 7 is detachably attached to the mouth 3 of the container main body 2. An open window 23 is provided in a top portion of a front portion of the outer circumferential wall 16.

The cap cover 8 is formed into a bottomed cylinder. A plug 25 protrudes on a lower surface of a central portion of the cap cover 8 to correspond to the outlet 12 of the cap main body 7. The plug 25 is configured to be fitted into the outlet 12 and close the outlet 12 when the cap cover 8 is closed. It is thereby possible to ensure a high shutoff performance. A lifted portion 26 having an inclined surface 26*a* raised forward is provided on a front end of the cap cover 8.

The opening/closing hinge 13 includes a spring band 27 and auxiliary connectors 28 provided on both sides of the spring band 27, respectively. The opening/closing hinge 13 is configured as follows. The opening/closing hinge 13 urges the cap cover 8 in a closing direction by a spring force until an angle of the cap cover 8 reaches a predetermined angle (about 45 degrees) from a closed state. In addition, an urging force of the opening/closing hinge 13 for urging the cap cover 8 in the closing direction is made higher as the angle of the cap cover 8 is closer to the predetermined angle. When the angle of the cap cover 8 exceeds the predetermined angle, an urging direction is reversed to urge the cap cover 8 toward an open direction. Finally, the spring force disappears in a state of opening the cap cover 8 at a predetermined opening angle and the state of opening the cap cover 8 is kept. When a content flows out from the outlet 12 of the cap main body 7, the cap cover 8 is kept open (at an angle of about 120 degrees to 180 degrees). In the state, the cap cover 8 does not disturb flowing of the content.

The support 9 is formed into a disc shape, a fitting hole 31 is formed in a central portion of the support 9 and the support 9 is externally fitted into and fixed to the outlet 12 via the fitting hole 31. A fitted wall 32 protrudes downward of an outer circumference of the support 9, and a depressed step 33 is provided on an inner circumference of an upper end of the outer circumferential wall 16 in a ring fashion. The fitted wall 32 of the support 9 is fitted into the depressed step 33, an engagement protrusion 35 projecting circumferentially outward is provided on the fitted wall 32, and an engagement protrusion 36 projecting circumferentially inward is provided on the depressed step 33. When the fitted wall 32 is fitted into the depressed step 33, the engagement protrusion 35 is engaged with the engagement protrusion 36 from lower side so as to prevent detachment of the fitted wall 32 from the depressed step 33. By so configuring, the support 9 is fitted into and fixedly attached into the upper end of the outer circumferential wall 16 of the cap main body 7 via the fitted wall 32 and fixedly attached to the cap main body 7 so as to close an area between the outlet 12 and the manipulation body 10 above the manipulation body 10. Furthermore, the support 9 is arranged to cover up downward of an outer circumference of the outlet 12 and fixedly attached to the container main body 2 so as to close the opening of the upper end of the accommodation concave portion 24.

The manipulation body 10 is formed into a shape of a ring having a pair of elastic connection rods 41, a manipulation portion 42 is provided between front ends of the paired elastic connection rods 41 and a pressing portion 43 is provided between rear ends of the paired elastic connection rods 41. The manipulation body 10 is accommodated in the accommodation concave portion 24 to be movable longitudinally and arranged below the support 9 in a top portion of the cap main body 7 to be movable longitudinally. The paired elastic connection rods 41 are arranged on both sides of the outlet 12, respectively below the support 9. The manipulation body 10 is connected to the support 9 only via the connection pieces 46 and portions of the manipulation body 10 other than portions connected to the support 9 via the connection pieces 46 are free (unconnected). The manipulation body 10 is configured so as not to have portions interfering with the other constituent elements when the manipulation body 10 moves longitudinally in the accommodation concave portion 24. The manipulation portion 42 protrudes outward of the open window 23 of the outer circumferential wall 16 and protrudes forward of front ends of the cap main body 7 and the cap cover 8.

A notch concave portion 38 is formed in a front end of the support 9 to correspond to the lifted portion 26. A rear edge of the manipulation portion 42 of the manipulation body 10 opposed to the notch concave portion 38 is denoted as a lifting portion 44. When the cap cover 8 is closed, the lifted portion 26 is inserted into the notch concave portion 38 and the inclined surface 26*a* of the lifted portion 26 is located backward of the lifting portion 44. When the manipulation portion 42 is pressed backward with the cap cover 8 in a closed state, then the lifting portion 44 presses the inclined surface 26*a* of the lifted portion 26 from forward, and the lifted portion 26 is lifted up so as to detach the plug 25 from the outlet 12.

Accordingly, the manipulation portion 42 is provided on the front end of the manipulating body 10 and the pressing portion 43 is provided on the rear end of the manipulating body 10. When the manipulating portion 42 is pressed backward, the front portion of the cap cover 8 is pressed upward in the front portion of the manipulating body 10 so as to swing the cap cover 8 in the open direction. In addition, by pressing the manipulation portion 42, the manipulation body 10 moves backward and the pressing portion 43 of the manipulation body 10 presses an opening/closing hinge 13 lower portion of the cap cover 8 so as to further swing the cap cover 8 in the open direction.

The manipulation body 10 is connected to the support 9 via the deformable connection pieces 46 so as to allow a longitudinal movement of the manipulation body 10 relative to the support 9. The manipulation body 10 is formed integrally with the support 9. The connection pieces 46 are a pair of connection pieces 41 provided on left and right sides of the pressing portion 43 and on front ends of the paired elastic connection rods 41, respectively. One end (a lower end) of each of the paired connection pieces 46 is bendably connected to each of the front ends of the paired elastic connection rods 41 whereas the other end (an upper end) of each of the paired connection pieces 46 is bendably connected to the front end of the support 9.

Figure 5:
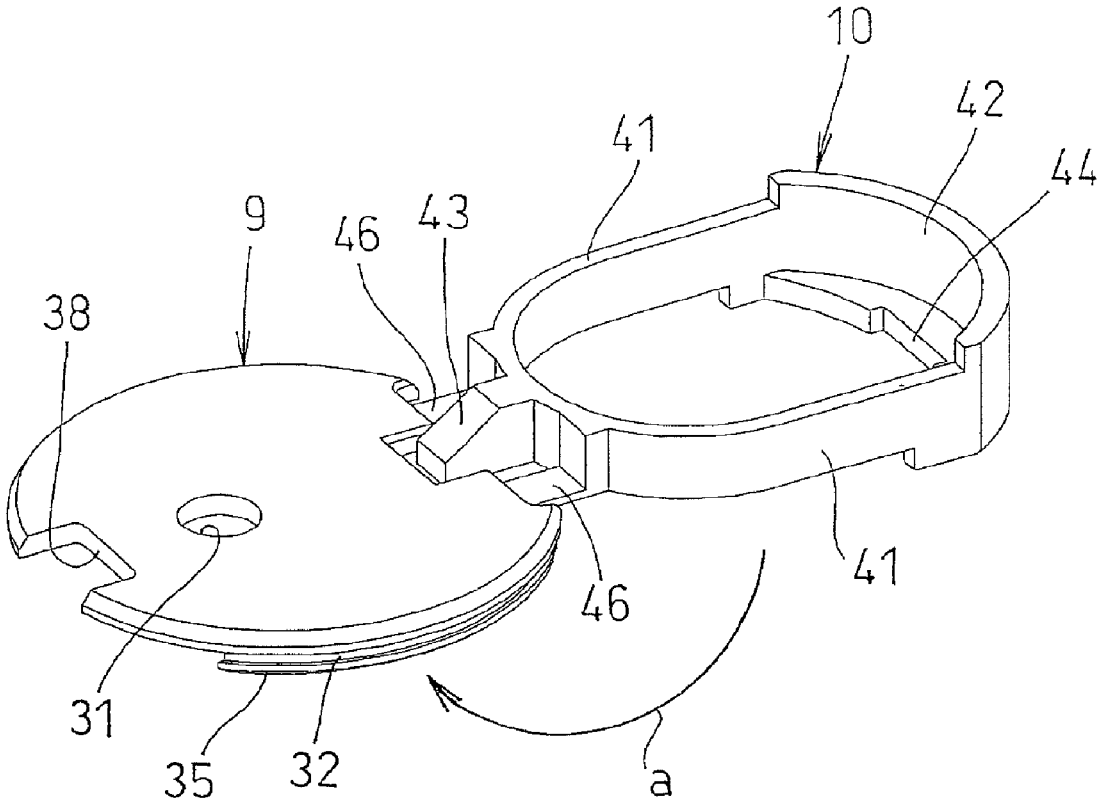
FIG. 5 is perspective views of a support and a manipulation body.
Figure 6:
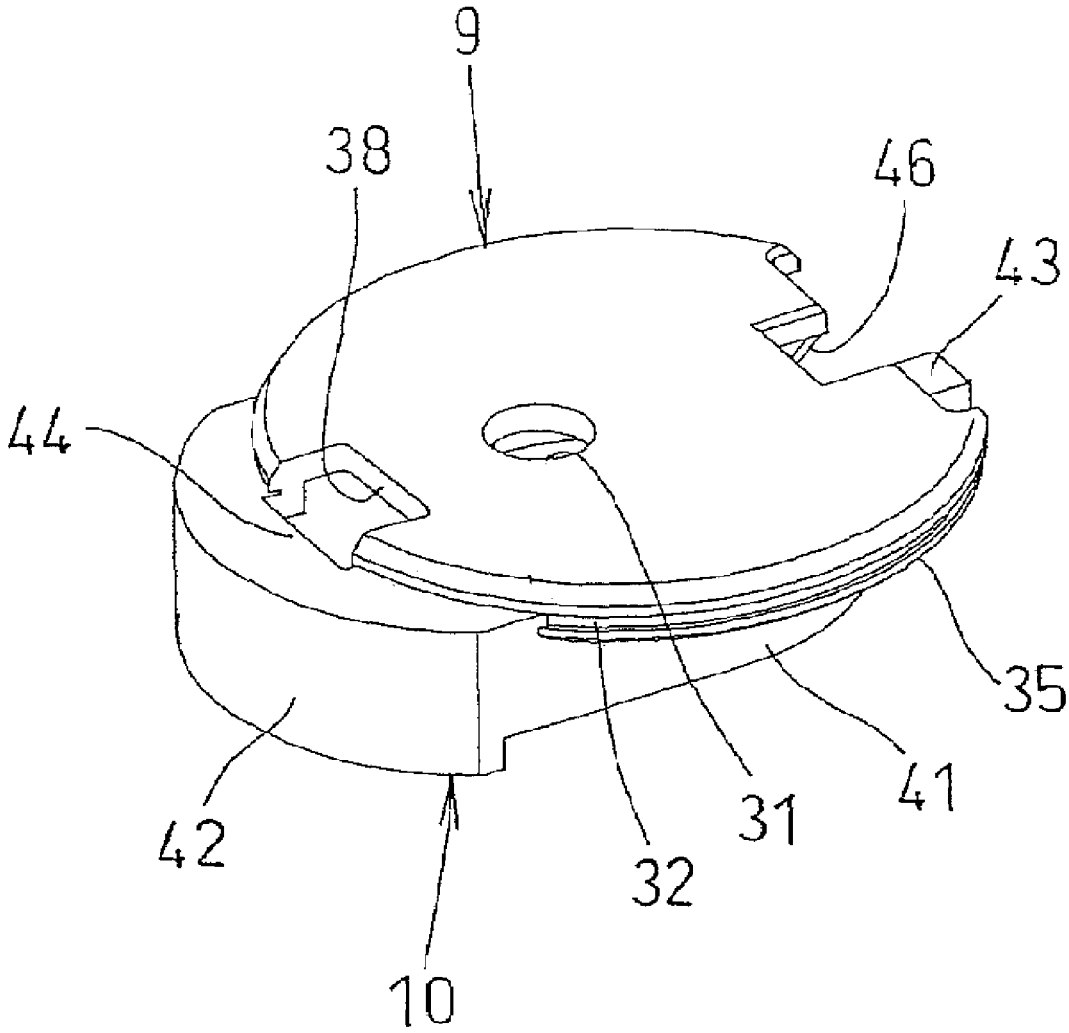
FIG. 6 is a perspective view of the manipulation body assembled to the support.
Figure 7:
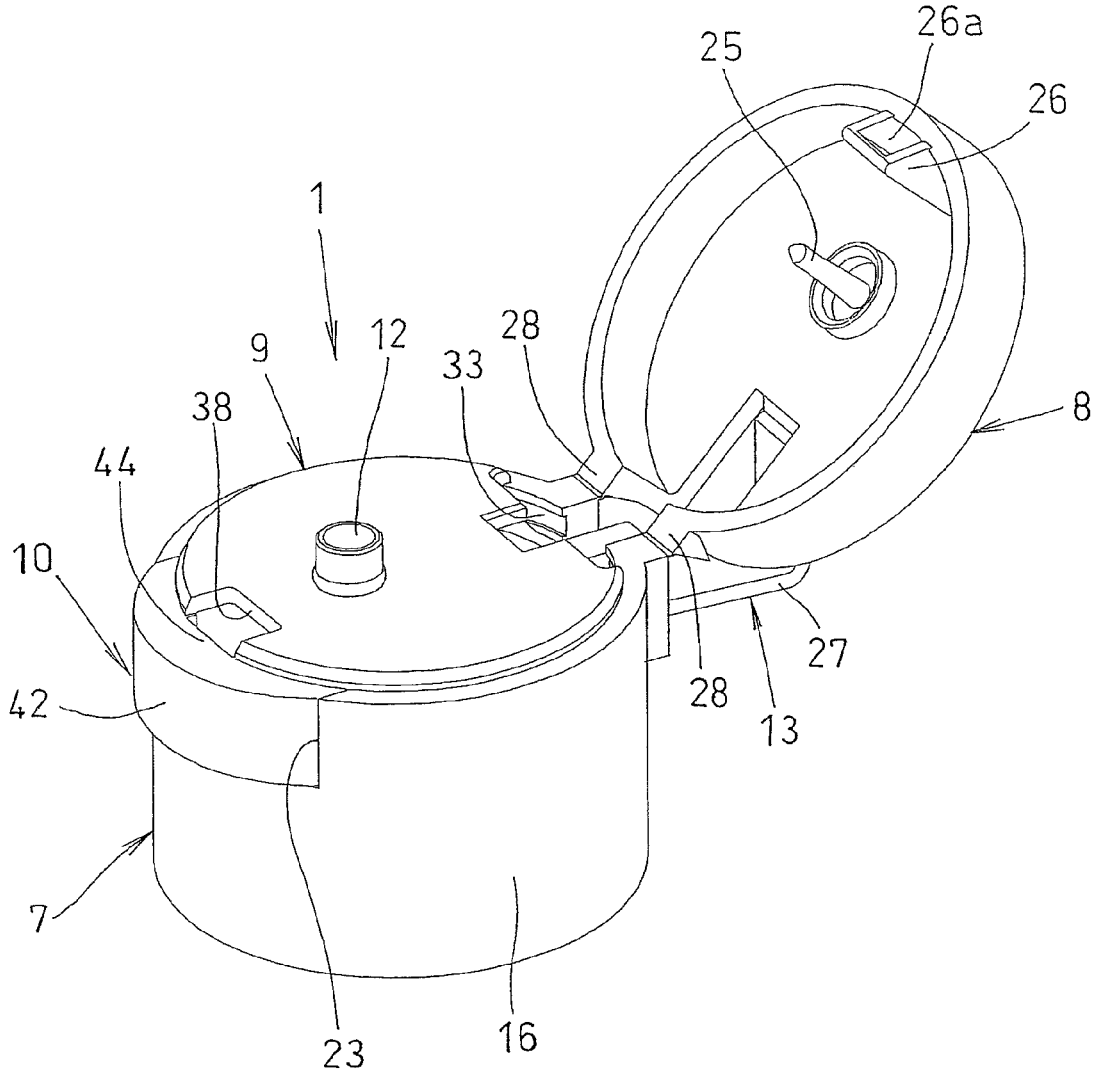
FIG. 7 is a perspective view of the cap having the manipulation body and the support assembled to a cap main body.
Figure 8:
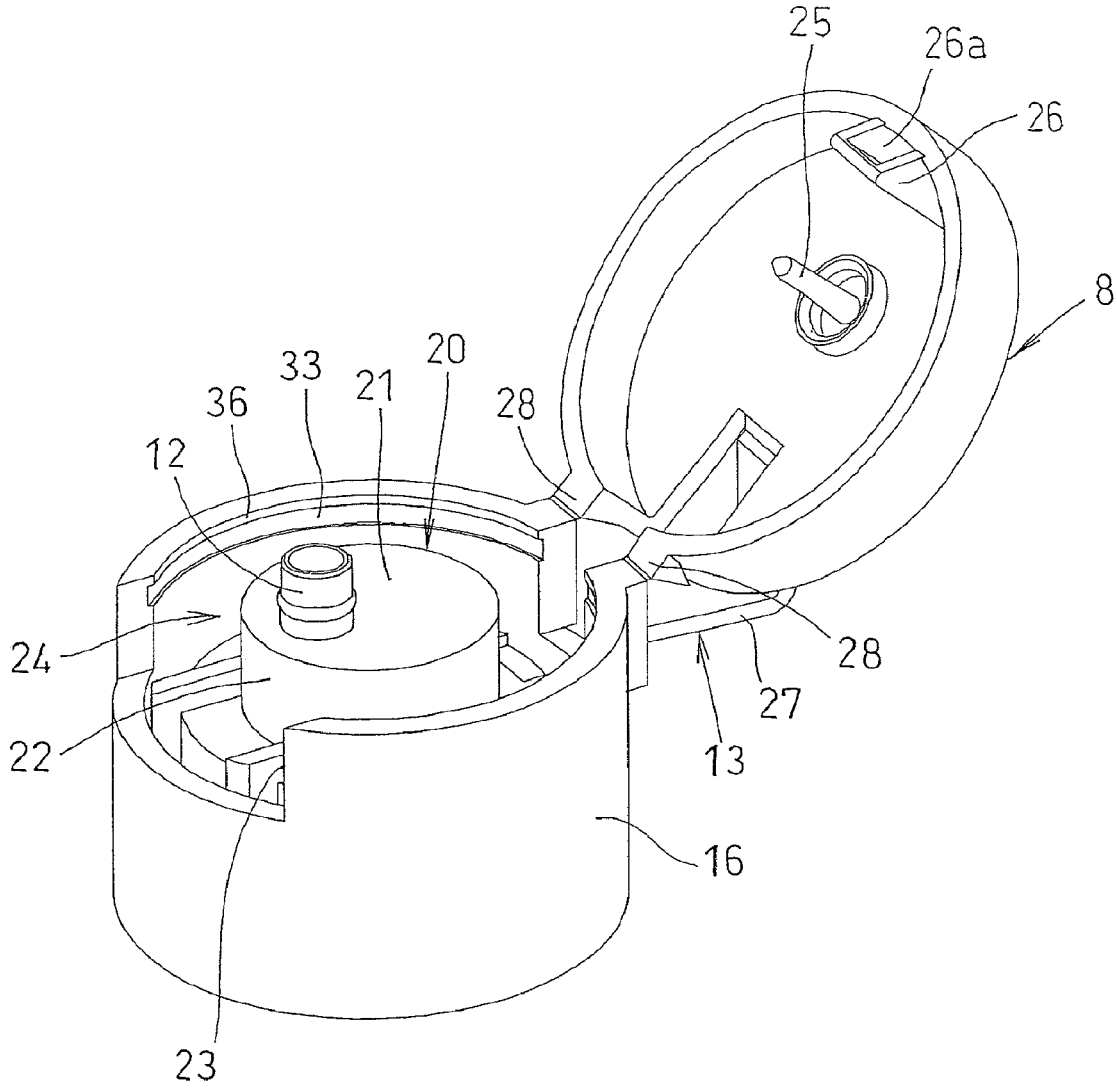
FIG. 8 is a perspective view of the cap main body without the manipulation body and the support.

According to the embodiment stated above, in the case where the cap 1 is to be manufactured, it suffices to carry out the following operations. The cap main body 7 and the cap cover 8 are formed integrally and the support 9 and the manipulation body 10 are formed integrally as shown in FIG. 5. Thereafter, the manipulation body 10 is rotated in an arrow a direction relatively to the support 9 with the connection pieces 46 set as fulcrums as shown in FIG. 5. The manipulation body 10 is assembled with the support 9 as shown in FIG. 6. Further, as shown in FIG. 8, the manipulation body 10 and the support 9 shown in FIG. 6 are assembled into a top surface of the cap main body 7 with the cap cover 8 open as shown in FIG. 8. It is thereby possible to easily manufacture the cap 1 while reducing the number of constituent elements of the cap 1. It is also possible to assemble the support 9 and the manipulation body 10 into the cap main body 7 as an integrated member and to thereby facilitate an assembly operation for assembling the cap 1.

Figure 2:
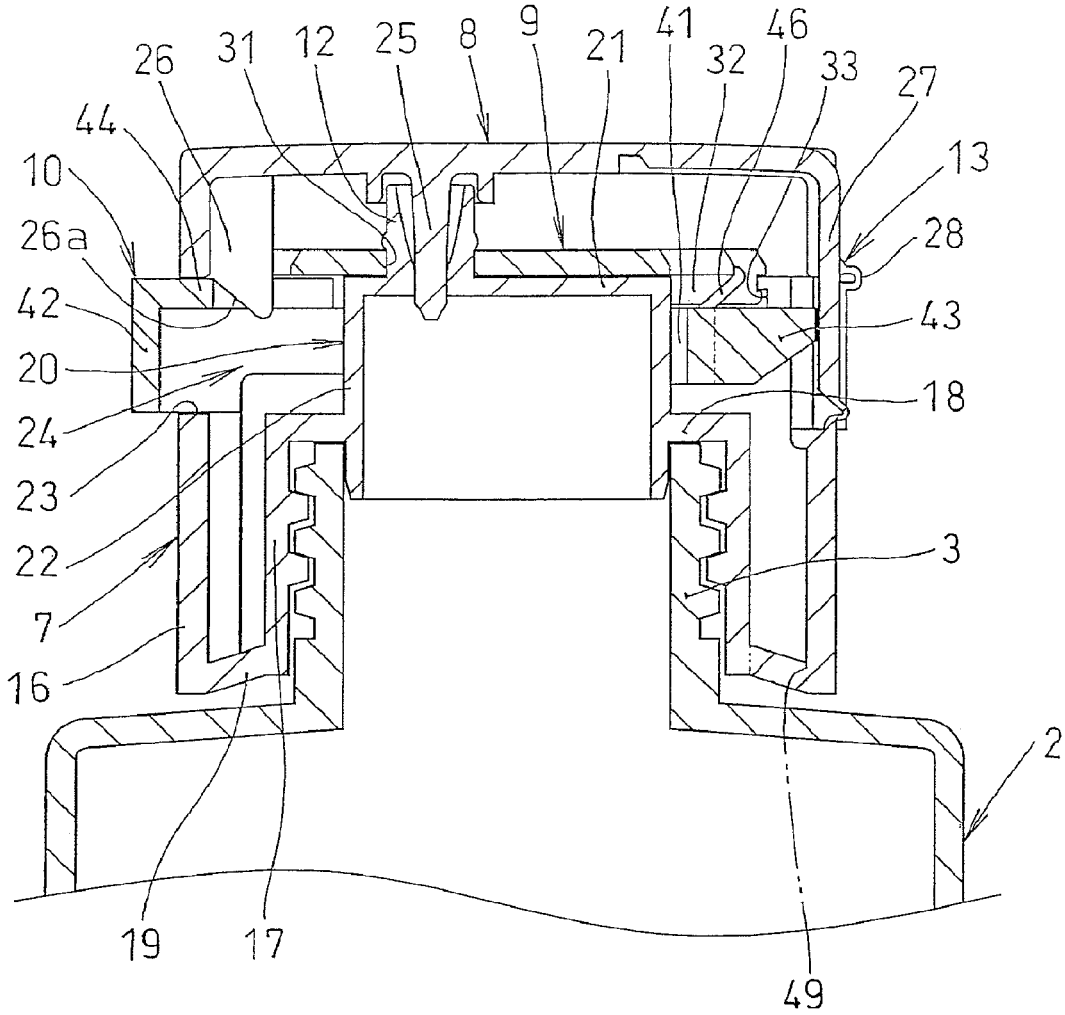
FIG. 2 is a sectional side view of the container showing the cap cover in a closed state in accordance with the embodiment of the present invention.
Figure 3:
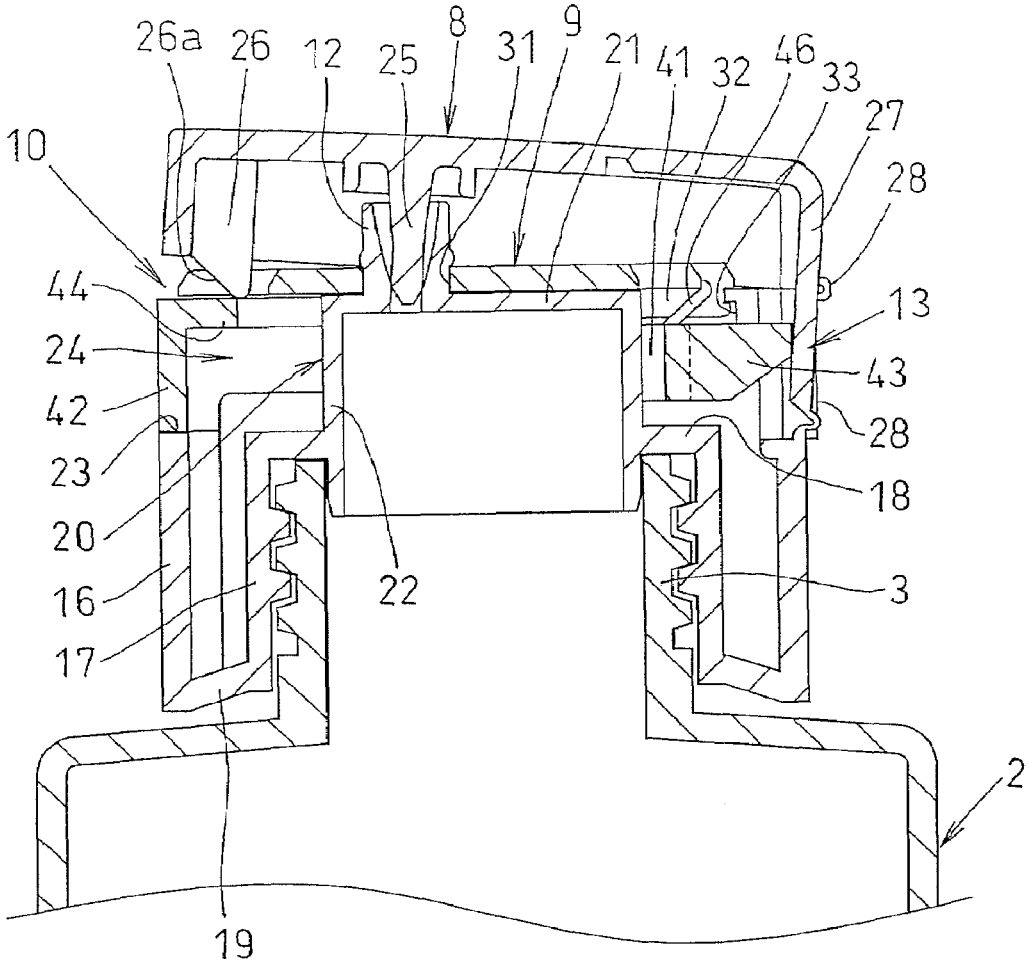
FIG. 3 is a sectional side view of the container showing the cap cover beginning to open in accordance with the embodiment of the present invention.
Figure 4:
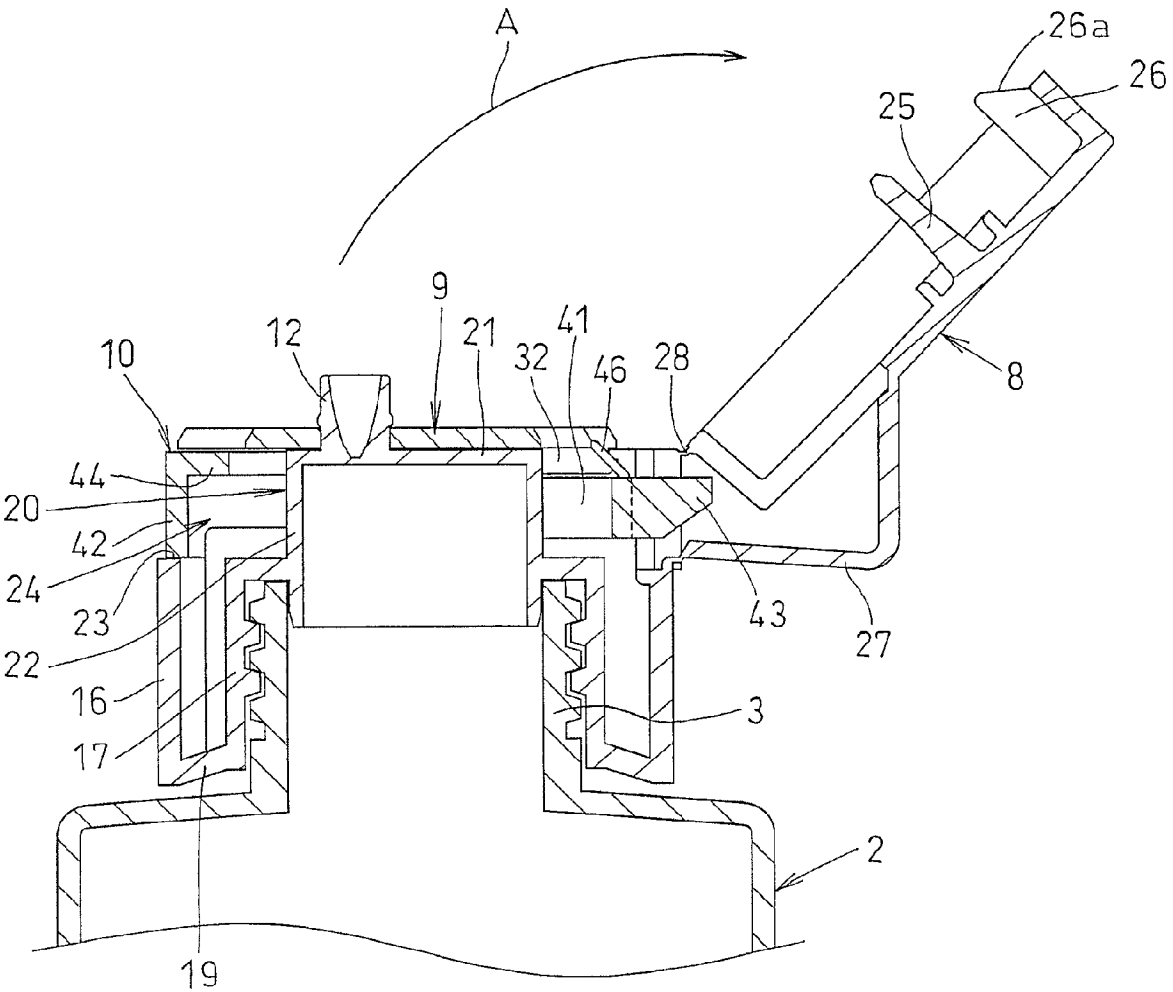
FIG. 4 is a sectional side view of the container showing the cap cover in the opened state in accordance with the embodiment of the present invention.

Moreover, as shown in FIG. 2, when the cap cover 8 in a closed state is to be opened, the manipulation portion 42 is pressed backward by a user's finger with the container held with one hand. By doing so, the lifting portion 44 of the manipulation body 10 presses the inclined surface 26*a* of the lifted portion 26 from forward, the front portion of the cap cover 8 is swung in the open direction and the lifted portion 26 is lifted up so as to detach the plug 25 from the outlet 12. Namely, when the manipulation portion 42 is pressed backward, the front portion of the cap cover 8 is pressed upward in the front portion of the manipulation body 10 so as to swing the cap cover 8 in the open direction. By doing so, the cap cover 8 can be swung smoothly in the open direction (arrow A direction shown in FIG. 4) against the spring force of the opening/closing hinge 13 even with a weak force, and the plug 25 can be easily detached from the outlet 12. At the same time, the manipulation body 10 moves slightly backward within the accommodation concave portion 24 by pressing the manipulation portion 42, the pressing portion 43 of the manipulation body 10 first abuts on the spring band 27 of the opening/closing hinge 13 of the container main body 2 and then the paired elastic connection rods 41 elastically deform to be laterally swollen to follow the backward movement of the manipulation portion 42 of the manipulation body 10. As a result, before the plug 25 is detached from the outlet 12 (when the cap cover 8 starts opening), an elastic force of the elastic connection rods 41 effectively relaxes and absorbs a force with which the pressing portion 43 presses the spring band 27 of the opening/closing hinge 13 and it is possible to prevent the pressing portion 43 to strongly press the opening/closing hinge 13 with an excessively strong force. Thereafter, in the case where the plug 25 is detached from the outlet 12 and the cap cover 8 starts swinging further greatly in the open direction, then the paired elastic connection rods 41 are extended toward backward by a restoring force produced by elastic deformation of the paired elastic connection rods 41, and the pressing portion 43 of the manipulation body 10 greatly moves backward. By doing so, the pressing portion 43 of the manipulation body 10 presses the spring band 27 of the opening/closing hinge 13 at a long stroke to thereby further greatly swing the cap cover 8 in the open direction. Therefore, before the manipulation portion 42 is manipulated by a predetermined amount after the pressing portion 43 abuts on the opening/closing hinge 13, a pressing force against the opening/closing hinge 13 can be accumulated to follow the elastic deformation of the paired elastic connection rods 41, the pressing portion 43 can press the opening/closing hinge 13 with a predetermined pressing force at a long stroke and it is possible to ensure opening the cap cover 8.

Therefore, by pressing the manipulation portion 42 backward by a thumb or the like of one hand by which the user grasps the container main body 2, the cap cover 8 can be easily opened with one hand by which the user grasps the container main body 2. Moreover, when the cap cover 8 starts opening, it is possible to prevent the pressing portion 43 from strongly pressing the opening/closing hinge 13. It is thereby possible to effectively prevent the opening/closing hinge 13 from being broken or damaged and smoothly and surely open the cover cap 8 with one hand for a long period of time.

Furthermore, most portions of the manipulation body 10 are accommodated in between the support 9 and the cap main body 7. Due to this, even if the cap cover 8 is opened, it is possible to prevent the manipulation body 10 from being greatly exposed to outside. Moreover, the support 9 is externally fitted into the outlet 12 so as to cover up downward of the outer circumference of the outlet 12, the manipulation body 10 is arranged below the support 9 and the support 9 is fixedly attached to the cap main body 7 so as to close the area between the outlet 12 and the manipulation body 10 above the manipulation body 10. Due to this, the support 9 can protect the content ejected from the outlet 12 from flowing out toward the manipulation body 10. It is thereby possible to prevent the content of the container main body 2 from adhering to the manipulation body 10. In this respect as well as the above-stated respect, the cap cover 8 can be opened smoothly for a long period of time.

Further, the manipulation body 10 is connected to the support 9 only via the connection pieces 46 and the portions of the manipulation body 10 other than portions connected to the support 9 via the connection pieces 46 are free (unconnected). Since the interfering portions are not present, a sliding resistance is low even during ordinary use (no interfering portions are present and a sliding resistance is low). Due to this, even if the content of the container adheres to the manipulation body 10, the manipulation body 10 is not so greatly adversely influenced by the adhesion of the content. Furthermore, even if the connection pieces 46 are broken and the manipulation body 10 separates from the support 9, the longitudinal movement of the manipulation body 10 is not disturbed.

Figure 9:
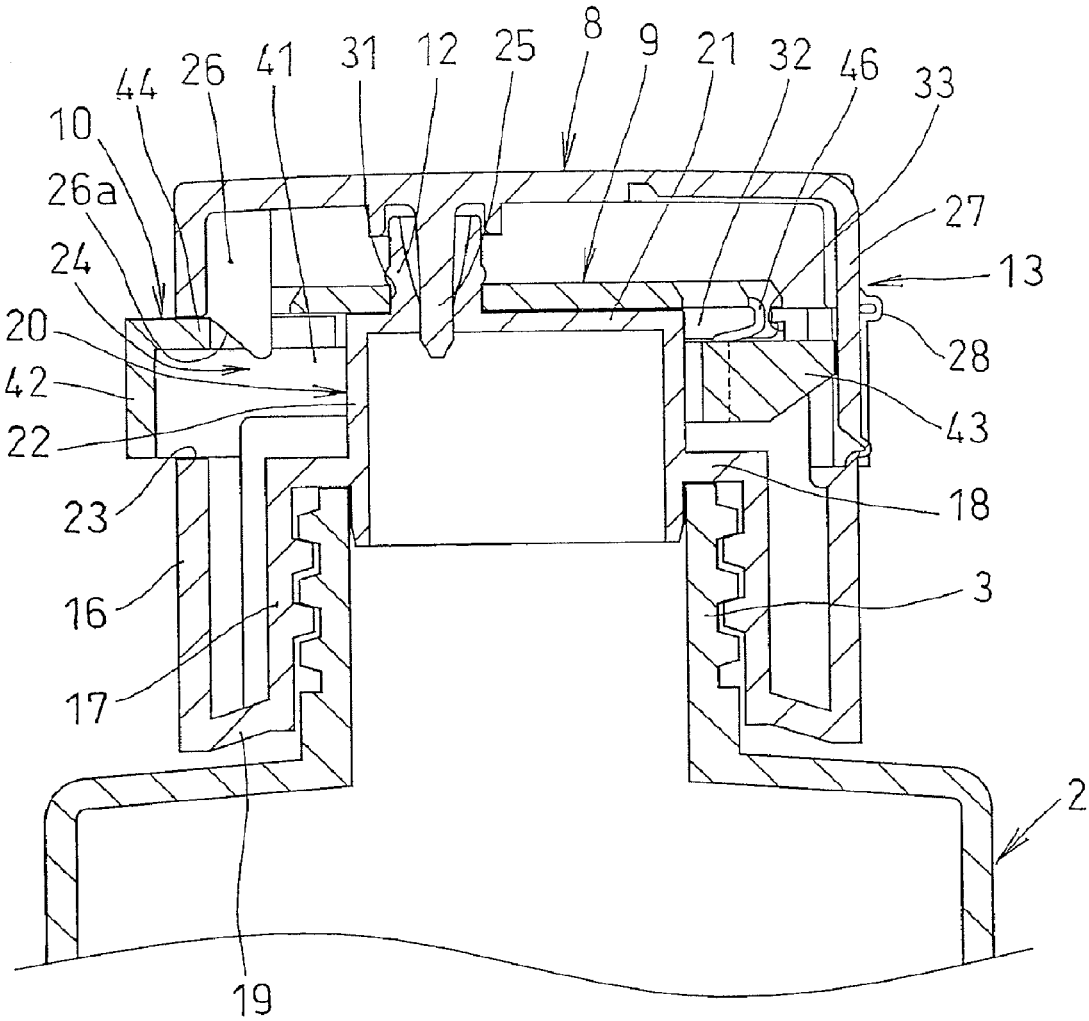
FIG. 9 is a sectional side view of a container showing a cap cover in a closed state in accordance with another embodiment of the present invention.

FIG. 9 shows a cap according to another embodiment of the present invention. A pair of connection pieces 46 is provided on left and right sides of a pressing portion 43 and on front ends of a pair of elastic connection rods 41, respectively. Each of the paired connection pieces 46 is formed into a belt shape so as to be flexibly bendable over an entire length. The cap according to the embodiment shown in FIG. 9 is similar to that according to the embodiment shown in FIGS. 1 to 8 in the other respects and can exhibit similar functions and advantages to those according to the preceding embodiment.

Figure 10:
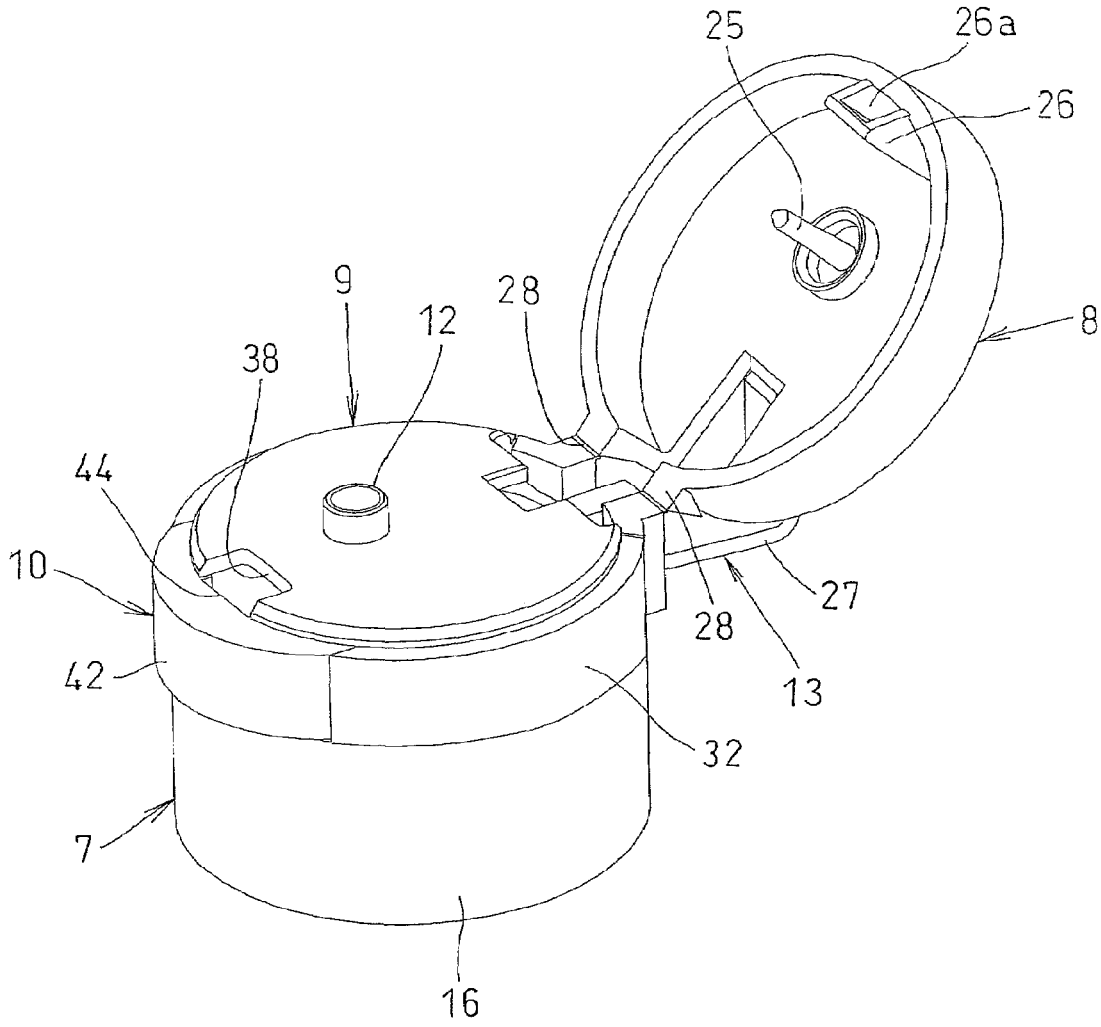
FIG. 10 is a perspective view of a cap showing another embodiment of the present invention.

FIG. 10 shows a cap according to yet another embodiment of the present invention. A fitted wall 32 protrudes downward of an outer circumference of the support 9 and the support 9 is externally fitted into and fixedly attached to an upper end of an outer circumferential wall 16 of a cap main body 7 via the fitted wall 32. The cap according to the embodiment shown in FIG. 10 is similar to that according to the embodiment shown in FIGS. 1 to 8 in the other respects.

Figure 11:
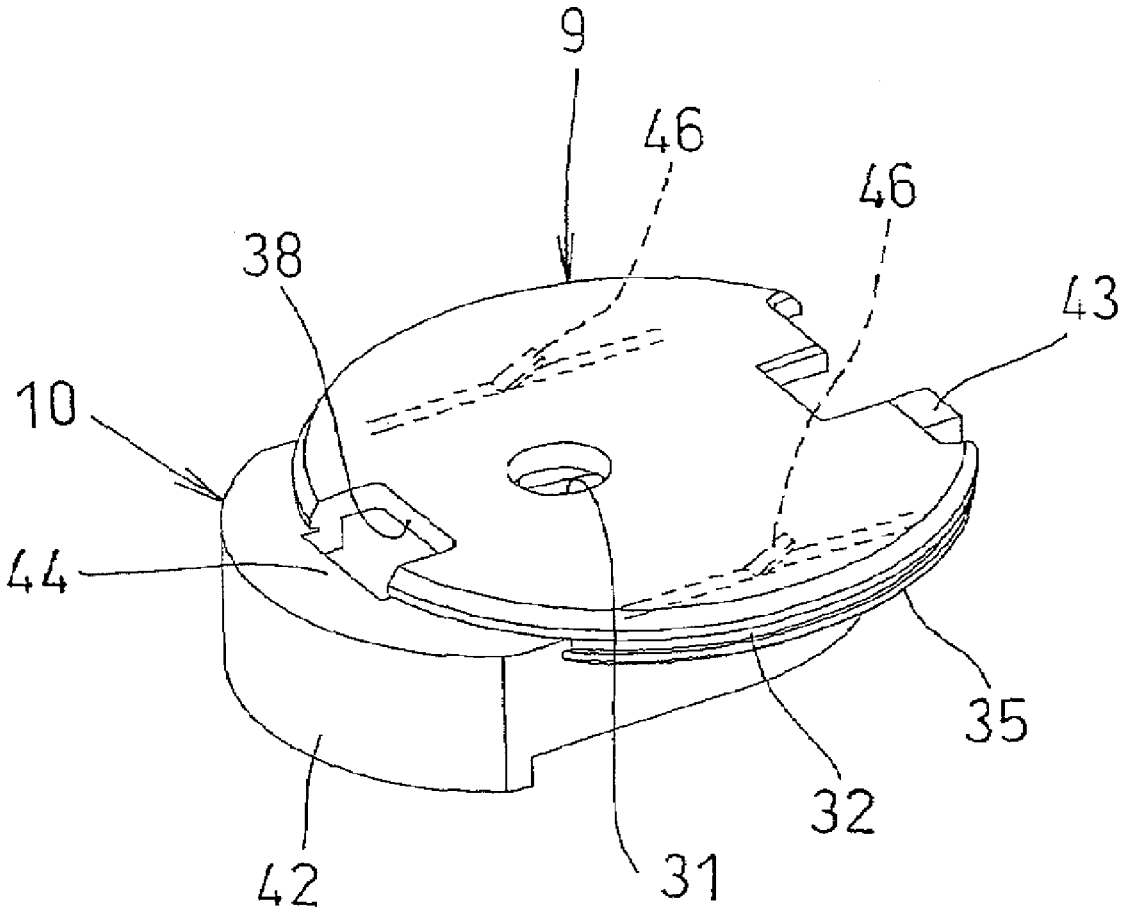
FIG. 11 is a perspective view of a manipulation body assembled to a support in accordance with another embodiment of the present invention.

FIG. 11 shows a cap according to still another embodiment of the present invention. A pair of connection pieces 46 is provided in longitudinal central portions of a pair of elastic connection rods 41, respectively. One end (a lower end) of each of the paired connection pieces 46 is bendably connected to each of front ends of the paired elastic connection rods 41 whereas the other end (an upper end) of each of the paired connection pieces 46 is bendably connected to a longitudinal portion halfway along the support 9. The cap according to the embodiment shown in FIG. 11 is similar to that according to the embodiment shown in FIGS. 1 to 8 in the other respects.

Figure 12:
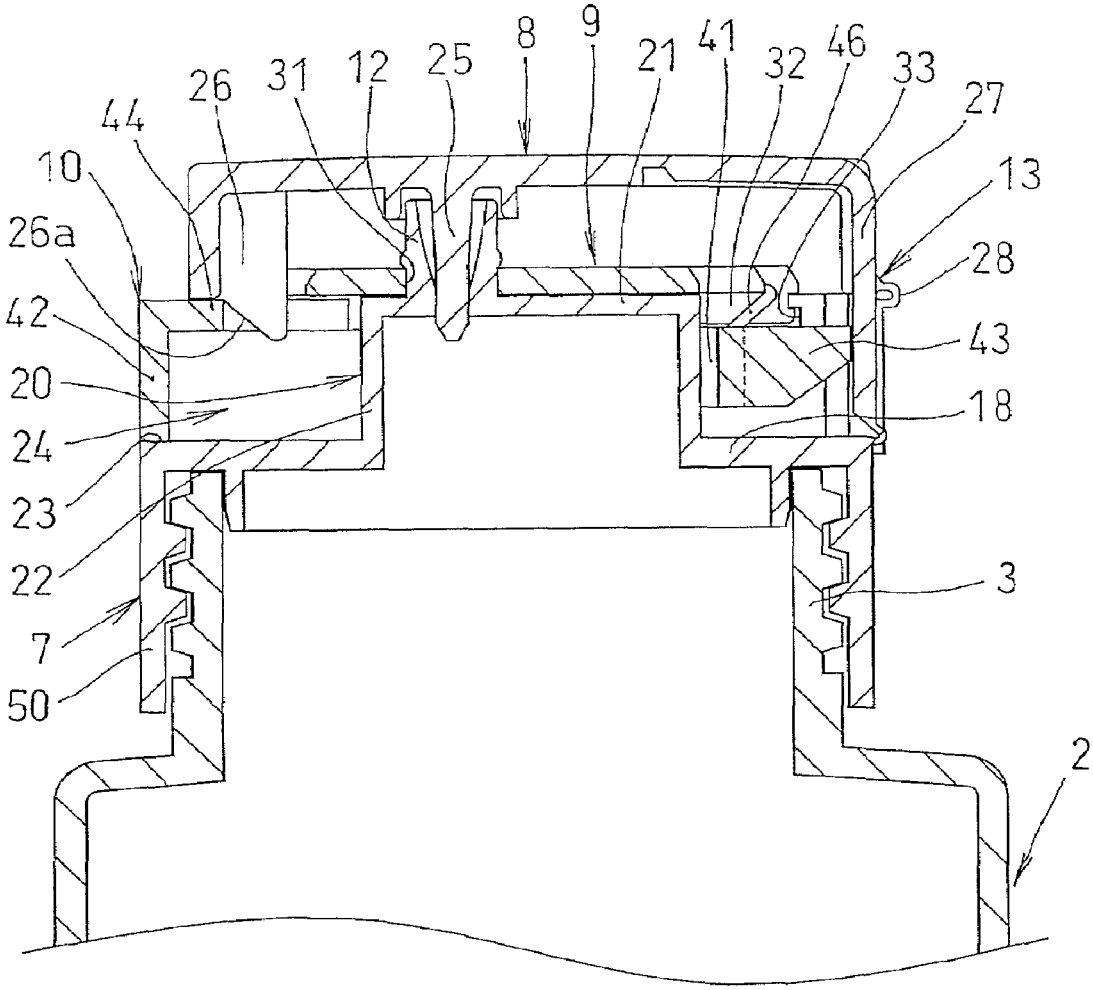
FIG. 12 is a sectional side view of a container in accordance with another embodiment of the present invention.

FIG. 12 shows a cap according to still another embodiment of the present invention. In the embodiment shown in FIGS. 1 to 8, the cap main body 7 includes the outer circumferential wall 16 and the inner circumferential wall 17 and the lower end of the inner circumferential wall 17 is connected to the lower end of the outer circumferential wall 16 by the connection wall 19. According to the embodiment shown in FIG. 12, by contrast, a cap main body 7 includes one circumferential wall 50 in place of the outer circumferential wall 16, the inner circumferential wall 17 and the connection wall 19. The circumferential wall 50 is detachably attached to a mouth 3 of a container main body 2 via a male screw and a female screw, thereby detachably attaching the cap main body 7 to the mouth 3 of the container main body 2. The cap according to the embodiment shown in FIG. 12 is similar to that according to the embodiment shown in FIGS. 1 to 8 in the other respects.

Figure 13:
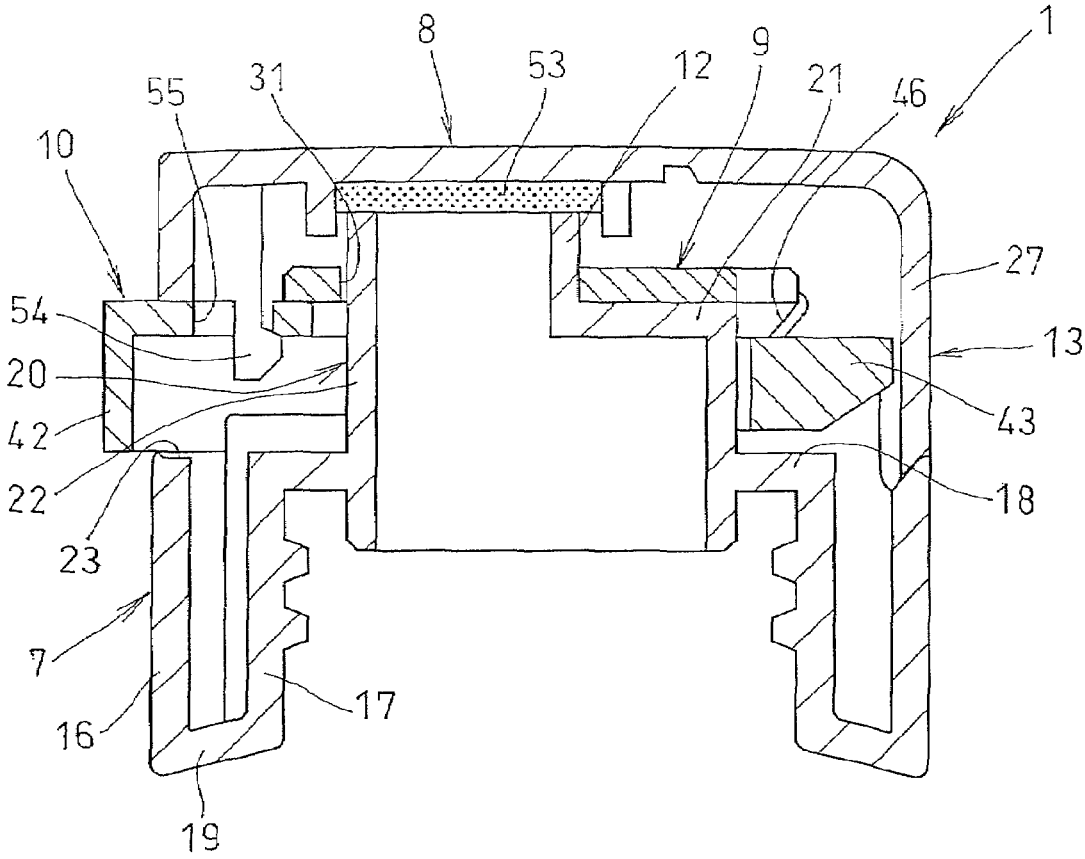
FIG. 13 is a sectional side view of a cap in accordance with another embodiment of the present invention.

FIG. 13 shows a cap according to still another embodiment of the present invention. A packing 53 is provided on a lower surface of a central portion of the cap cover 8 to correspond to an outlet 12 of a cap main body 7 in place of the plug 25. The packing 53 is configured to press an upper end of the outlet 12 and to close the outlet 12 when the cap cover 8 is closed.

Furthermore, a hook 54 projecting downward is provided on a front end of the cap cover 8 in place of the lifted portion 26 and an engagement hole (engagement portion) 55 is provided on a manipulation portion 42 of a manipulation body 10 to correspond to the hook 54 in place of the lifting portion 44. When the cap cover 8 is closed, the hook 54 is inserted into the engagement hole 55 from upward and disengageably engaged with a lower opening edge of the engagement hole 55 from below so as to keep the cap cover 8 at a closed position. When the manipulation portion 42 of the manipulation body 10 is pressed backward, the engagement hole 55 of the manipulation body 10 moves backward, thereby disengaging the hook 54 from the engagement hole 55. Therefore, the cap according to the embodiment shown in FIG. 13 is configured so that when the manipulation portion 42 is pressed with the cap cover 8 in a closed state, engagement of the hook 54 with the engagement hole 55 for keeping the cap cover 8 at the closed position is released, and so that the pressing portion 43 presses the opening/closing hinge 13 of the cap cover 8 backward to swing the cap cover 8 in an open direction. The cap according to the embodiment shown in FIG. 13 is similar to that according to the embodiment shown in FIGS. 1 to 8 in the other respects.

In the embodiment shown in FIG. 13, the hook 54 of the cap cover 8 is engaged with the manipulation body 10 to thereby keep the cap cover 8 at the closed position. Alternatively, an engagement portion with which the hook 54 is engaged may be provided on a cap main body 7. In this alternative, the hook 54 of the cap cover 8 is engaged with the engagement portion of the cap main body 7 to thereby keep the cap cover 8 at the closed position. Further, when the manipulation portion 42 of the manipulation body 10 is pressed, the hook 54 is disengaged from the engagement portion of the cap main body 7. By so configuring, when the manipulation portion 42 is pressed with the cap cover 8 in a closed state, then the engagement of the hook 54 with the engagement portion of the cap main body 7 for keeping the cap cover 8 at the closed position is released, and the pressing portion 43 presses the opening/closing hinge 13 of the cap cover 8 backward to swing the cap cover 8 in the open direction.

In case of the embodiment shown in FIGS. 1 to 8, water is often accumulated in between the outer circumferential wall 16 and the inner circumferential wall 17 of the cap main body 7. Due to this, as indicated by a chain line in FIG. 2, for example, a drain hole 49 may be provided in the connection wall 19 so as to be able to discharge the water accumulated in between the outer circumferential wall 16 and the inner circumferential wall 17 to outside of the cap from the drain hole 49.

Moreover, in the embodiment shown in FIGS. 1 to 8, the paired connection pieces 46 are provided to correspond to the paired elastic connection rods 41, one end of each of the paired connection pieces 46 is connected to each of the paired elastic connection rods 41 and the other end of each of the paired connection pieces 46 is connected to the support 9. Alternatively, only one connection piece 46 may be provided to correspond to a front end (manipulation portion 42) or a rear end (pressing portion 43) of the manipulation body 10 and the manipulation body 10 may be connected to the support 9 by one connection piece 46.

Furthermore, in the embodiment shown in FIGS. 1 to 8, the manipulation body 10 is formed into the ring having a pair of elastic connection rods 41 arranged on the both sides of the outlet 12, respectively below the support 9, the manipulation portion 42 is provided between the front ends of the paired elastic connection rods 41 and the pressing portion 43 is provided between the rear ends of the paired elastic connection rods 41. Alternatively, the manipulation body 10 may be configured to include only one elastic connection rod 41 arranged on a side of the outlet 12 below the support 9 instead of using the paired elastic connection rods 41, the manipulation portion 42 may be provided on one end of the one elastic connection rod 41 and the pressing portion 43 may be provided on the other end of the elastic connection rod 41.

Further, in the embodiment shown in FIGS. 1 to 8, the manipulation body 10 is formed into the cylindrical ring having a pair of elastic connection rods 41 arranged on both sides of the outlet 12, respectively and configured so that the paired elastic connection rods 41 elastically deform to be laterally swollen when pressing the manipulation portion 42. Alternatively, the manipulation body 10 may be formed into a disc ring having a pair of elastic connection rods 41 arranged on both sides of the outlet 12, respectively and thereby configured so that the paired elastic connection rods 41 elastically deform to be vertically bent when pressing the manipulation portion 42.

Moreover, in the embodiment shown in FIGS. 1 to 8, the support 9 is externally fitted into and fixed to the outlet 12 via the fitting hole 31 and fitted into and fixedly attached to the outer circumferential wall 16 of the cap main body 7. Alternatively, the support 9 may be fixedly attached to only one of the outlet 12 and the outer circumferential wall 16 or may be fixedly attached to a region other than the outlet 12 and the outer circumferential wall 16 of the cap main body 7.

Furthermore, in the embodiment shown in FIGS. 1 to 8, the manipulation portion 42 is provided on the front end of the manipulation body 10 and pressed backward. Alternatively, the manipulation portion 42 may be provided at a left or right side or the other position of the manipulation body 10 instead of the front end of the manipulation body 10. By so configuring, when the manipulation portion 42 is pressed laterally inward or the like, the front portion of the cap cover 8 is pressed upward in the manipulation portion 42 of the manipulation body so as to swing the cap cover 8 in the open direction. In addition, the pressing portion 43 presses the opening/closing hinge 13 of the cap cover 8 backward to further swing the cap cover 8 in the open direction.

What is claimed is:

1. A cap comprising:

a cap main body attached to a mouth of a container main body and including an outlet;

a cap cover connected to a rear end of the cap main body via an opening/closing hinge so as to be able to cover a top portion of the cap main body with the cap cover and to freely open or close the top portion of the cap main body; and a support fixed to the cap main body and a manipulation body supported by the support, the manipulation body being arranged on the top portion of the cap main body to be longitudinally movable, the support being fixedly attached to the cap main body so as to close an area between the outlet and the manipulation body above the manipulation body, the manipulation body being provided with a manipulation portion and with a pressing portion on a rear end of the manipulation body, the pressing portion pressing the opening/closing hinge of the cap cover backward to swing the cap cover in an open direction when the manipulation portion is pressed, wherein said manipulation body includes an elastic connection rod arranged on a side of the outlet below the support, said manipulation portion is provided on one end of the elastic connection rod, said pressing portion is provided on other end of the elastic connection rod, and the manipulation body is connected to the support via a deformable connection piece so as to allow a movement of the manipulation body relative to the support.

2. The cap according to claim 1, wherein when the manipulation portion is pressed with the cap cover in a closed state, a front portion of the cap cover is pressed upward in a manipulation portion of the manipulation body so as to swing the cap cover in an open direction, and the pressing portion presses the opening/closing hinge of the cap cover backward to further swing the cap cover in the open direction.

3. The cap according to claim 2, wherein the cap main body includes an outer circumferential wall, an inner circumferential wall and a top wall, the inner circumferential wall is externally fitted into the mouth of the container main body, a convex portion projecting upward is provided on the top wall, said outlet is provided to project upward of a top wall of the concave portion, and said accommodation concave portion is formed between a top portion of the outer circumferential wall and a circumferential wall of the convex portion.

4. The cap according to claim 1, wherein when the manipulation portion is pressed with the cap cover in a closed state, then engagement for keeping the cap cover at a closed position is released, and the pressing portion presses the opening/closing hinge of the cap cover backward to swing the cap cover in an open direction.

5. The cap according to claim 4, wherein the cap main body includes an outer circumferential wall, an inner circumferential wall and a top wall, the inner circumferential wall is externally fitted into the mouth of the container main body, a convex portion projecting upward is provided on the top wall, said outlet is provided to project upward of a top wall of the concave portion, and said accommodation concave portion is formed between a top portion of the outer circumferential wall and a circumferential wall of the convex portion.

6. The cap according to claim 1, wherein said manipulation body is formed into a shape of a ring having a pair of elastic connection rods arranged on both sides of the outlet, respectively below the support, said manipulation portion is provided between front ends of the pair of elastic connection rods, said pressing portion is provided between rear ends of the pair of elastic connection rods, and the manipulation body is connected to the support via the deformable connection piece so as to allow a longitudinal movement of the manipulation body relative to the support.

7. The cap according to claim 6, wherein the cap main body includes an outer circumferential wall, an inner circumferential wall and a top wall, the inner circumferential wall is externally fitted into the mouth of the container main body, a convex portion projecting upward is provided on the top wall, said outlet is provided to project upward of a top wall of the concave portion, and said accommodation concave portion is formed between a top portion of the outer circumferential wall and a circumferential wall of the convex portion.

8. The cap according to claim 1, wherein an accommodation concave portion having an opening on an upper end is provided in the cap main body so as to surround downward of the outlet, the manipulation body is accommodated in the accommodation concave portion to be movable longitudinally, and the support is fixedly attached to the cap main body so as to close the opening of the upper end of the accommodation concave portion.

9. The cap according to claim 8, wherein a fitting hole is provided in the support, and the support is externally fitted into and fixed to the outlet via the fitting hole and fitted into and fixedly attached to the cap main body so as to close the opening of the upper end of the accommodation concave portion.

10. The cap according to claim 9, wherein the cap main body includes an outer circumferential wall, an inner circumferential wall and a top wall, the inner circumferential wall is externally fitted into the mouth of the container main body, a convex portion projecting upward is provided on the top wall, said outlet is provided to project upward of a top wall of the concave portion, and said accommodation concave portion is formed between a top portion of the outer circumferential wall and a circumferential wall of the convex portion.

11. The cap according to claim 8, wherein the cap main body includes an outer circumferential wall, an inner circumferential wall and a top wall, the inner circumferential wall is externally fitted into the mouth of the container main body, a convex portion projecting upward is provided on the top wall, said outlet is provided to project upward of a top wall of the concave portion, and said accommodation concave portion is formed between a top portion of the outer circumferential wall and a circumferential wall of the convex portion.

12. The cap according to claim 1, wherein one end of said connection piece is bendably connected to the manipulation body and other end of said connection piece is bendably connected to the support.

13. The cap according to claim 12, wherein the cap main body includes an outer circumferential wall, an inner circumferential wall and a top wall, the inner circumferential wall is externally fitted into the mouth of the container main body, a convex portion projecting upward is provided on the top wall, said outlet is provided to project upward of a top wall of the concave portion, and said accommodation concave portion is formed between a top portion of the outer circumferential wall and a circumferential wall of the convex portion.

14. The cap according to claim 1, wherein said connection piece is formed into a belt shape so as to be flexibly bendable over an entire length.

15. The cap according to claim 14, wherein the cap main body includes an outer circumferential wall, an inner circumferential wall and a top wall, the inner circumferential wall is externally fitted into the mouth of the container main body, a convex portion projecting upward is provided on the top wall, said outlet is provided to project upward of a top wall of the concave portion, and said accommodation concave portion is formed between a top portion of the outer circumferential wall and a circumferential wall of the convex portion.

16. The cap according to claim 1, wherein the cap main body includes an outer circumferential wall, an inner circumferential wall and a top wall, the inner circumferential wall is externally fitted into the mouth of the container main body, a convex portion projecting upward is provided on the top wall, said outlet is provided to project upward of a top wall of the concave portion, and said accommodation concave portion is formed between a top portion of the outer circumferential wall and a circumferential wall of the convex portion.

* * * * *